US009894954B2

(12) United States Patent
Beers et al.

(10) Patent No.: US 9,894,954 B2
(45) Date of Patent: Feb. 20, 2018

(54) SOLE PLATE FOR AN ARTICLE OF FOOTWEAR

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 63 days.

(21) Appl. No.: 14/723,994

(22) Filed: May 28, 2015

(65) Prior Publication Data

US 2016/0345671 A1 Dec. 1, 2016

(51) Int. Cl.

| | |
|---|---|
| ***A43B 13/42*** | (2006.01) |
| ***A43B 13/12*** | (2006.01) |
| ***A43B 13/14*** | (2006.01) |
| ***A43B 1/00*** | (2006.01) |
| ***A43B 3/00*** | (2006.01) |
| ***A43B 11/00*** | (2006.01) |
| ***A43C 11/00*** | (2006.01) |
| ***A43C 11/16*** | (2006.01) |

(52) U.S. Cl.

CPC ..... *A43B 1/0072* (2013.01); *A43B 3/001* (2013.01); *A43B 3/0005* (2013.01); *A43B 3/0031* (2013.01); *A43B 11/00* (2013.01); *A43C 11/006* (2013.01); *A43C 11/165* (2013.01)

(58) Field of Classification Search

CPC ..... A43B 13/42; A43B 13/12; A43B 13/14; A43B 3/0031; A43B 3/108; A43B 3/128

USPC ..... 36/30 R, 50.1

See application file for complete search history.

(56) References Cited

U.S. PATENT DOCUMENTS

| | | | | |
|---|---|---|---|---|
| 4,466,204 A | | 8/1984 | Wu | |
| 4,848,009 A | | 7/1989 | Rodgers | |
| 5,592,759 A | * | 1/1997 | Cox | A43B 1/0054 36/136 |
| 5,765,300 A | | 6/1998 | Kianka | |
| 5,832,634 A | * | 11/1998 | Wong | A43B 13/026 36/107 |
| 6,061,929 A | * | 5/2000 | Ritter | A43B 3/0052 36/107 |
| 6,691,433 B2 | | 2/2004 | Liu | |
| 6,788,200 B1 | | 9/2004 | Jamel et al. | |

(Continued)

FOREIGN PATENT DOCUMENTS

| | | |
|---|---|---|
| EP | 2253238 | 11/2010 |
| JP | 2002119498 | 4/2002 |
| WO | WO-2016191124 A1 | 12/2016 |

OTHER PUBLICATIONS

"International Application Serial No. PCT/US2016/032280, International Search Report dated Sep. 7, 2016", 7 pgs.

(Continued)

*Primary Examiner* — Jila M Mohandesi

(74) *Attorney, Agent, or Firm* — Schwegman Lundberg & Woessner, P.A.

(57) ABSTRACT

An article of footwear can include provisions for facilitating the installation of various components. A sole plate can include one or more specialized compartments designed to receive a component. The sole plate can be configured to provide greater stability to a sole structure. In some cases, the sole plate can be used to receive a component that can be used to perform different functions in a motorized tensioning system.

11 Claims, 12 Drawing Sheets

(56) References Cited

U.S. PATENT DOCUMENTS

| | | | | |
|---|---|---|---|---|
| 7,210,253 | B2 * | 5/2007 | Yu | A43B 3/00 36/141 |
| 7,225,565 | B2 | 6/2007 | DiBenedetto et al. | |
| 7,254,910 | B2 | 8/2007 | Guzman | |
| 7,596,891 | B2 * | 10/2009 | Carnes | A43B 3/00 36/132 |
| 7,607,243 | B2 | 10/2009 | Berner, Jr. et al. | |
| 7,789,520 | B2 | 9/2010 | Konig et al. | |
| 7,794,101 | B2 | 9/2010 | Galica et al. | |
| 7,802,382 | B2 * | 9/2010 | Eades | A43B 3/0031 36/1 |
| 8,001,704 | B2 * | 8/2011 | Baudouin | A43B 7/1495 36/102 |
| 8,056,269 | B2 | 11/2011 | Beers et al. | |
| 8,058,837 | B2 | 11/2011 | Beers et al. | |
| 8,086,421 | B2 | 12/2011 | Case, Jr. et al. | |
| 8,234,798 | B2 | 8/2012 | DiBenedetto et al. | |
| 8,302,233 | B2 * | 11/2012 | Spanks | A43B 1/0072 12/142 F |
| 8,384,551 | B2 | 2/2013 | Ross et al. | |
| 8,479,416 | B2 * | 7/2013 | Auger | A43B 7/1445 36/102 |
| 8,628,453 | B2 | 1/2014 | Balakrishnan et al. | |
| 8,771,148 | B2 | 7/2014 | Balakrishnan et al. | |
| 8,879,685 | B2 | 11/2014 | Oshio | |
| 8,935,860 | B2 | 1/2015 | Torres | |
| 8,938,892 | B2 | 1/2015 | Case, Jr. | |
| 2003/0070324 | A1 | 4/2003 | Nelson | |
| 2005/0126049 | A1 | 6/2005 | Koenig | |
| 2006/0156588 | A1 | 7/2006 | Ferrell | |
| 2007/0130804 | A1 | 5/2007 | Levy et al. | |
| 2008/0203144 | A1 | 8/2008 | Kim | |
| 2009/0272013 | A1 | 11/2009 | Beers et al. | |
| 2010/0223816 | A1 | 9/2010 | Barfield | |
| 2010/0251565 | A1 | 10/2010 | Litchfield et al. | |
| 2011/0054359 | A1 | 3/2011 | Sazonov et al. | |
| 2011/0107771 | A1 | 5/2011 | Crist et al. | |
| 2011/0175744 | A1 | 7/2011 | Englert et al. | |
| 2011/0225843 | A1 | 9/2011 | Kerns et al. | |
| 2011/0260857 | A1 | 10/2011 | Hamill | |
| 2011/0266384 | A1 | 11/2011 | Goodman et al. | |
| 2012/0000091 | A1 | 1/2012 | Cotterman et al. | |
| 2012/0234111 | A1 | 9/2012 | Molyneux et al. | |
| 2013/0019694 | A1 * | 1/2013 | Molyneux | A43B 3/0005 73/862.381 |
| 2013/0067765 | A1 | 3/2013 | Auger et al. | |
| 2013/0130843 | A1 | 5/2013 | Burroughs et al. | |
| 2013/0211290 | A1 * | 8/2013 | Lee | A43B 3/0005 600/592 |
| 2013/0213144 | A1 | 8/2013 | Rice et al. | |
| 2013/0219754 | A1 | 8/2013 | Nowak et al. | |
| 2014/0057233 | A1 | 2/2014 | Morag et al. | |
| 2014/0068838 | A1 | 3/2014 | Beers et al. | |
| 2014/0070042 | A1 | 3/2014 | Beers et al. | |
| 2014/0082963 | A1 | 3/2014 | Beers | |
| 2014/0228987 | A1 | 8/2014 | Case, Jr. et al. | |
| 2014/0244009 | A1 | 8/2014 | Mestas | |
| 2014/0249660 | A1 | 9/2014 | Prstojevich | |
| 2014/0277632 | A1 | 9/2014 | Walker | |
| 2014/0330409 | A1 | 11/2014 | Case, Jr. et al. | |
| 2014/0358472 | A1 | 12/2014 | Goel et al. | |
| 2015/0059204 | A1 | 3/2015 | Alexander et al. | |
| 2015/0096204 | A1 | 4/2015 | Case, Jr. | |
| 2015/0104772 | A1 | 4/2015 | Goel et al. | |
| 2016/0345661 | A1 | 12/2016 | Beers et al. | |

OTHER PUBLICATIONS

"International Application Serial No. PCT/US2016/032280, Written Opinion dated Sep. 7, 2016", 6 pgs.

* cited by examiner

SOLE PLATE FOR AN ARTICLE OF FOOTWEAR

BACKGROUND

The present embodiments relate generally to articles of footwear and including removable motorized adjustment systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to a sole plate for an article of footwear, comprising a forward portion, an intermediate portion, and a rearward portion, as well as a longitudinal axis, a lateral axis, and a midline. There is a compartment disposed within the intermediate portion, and the compartment comprises a cavity. There is also a central axis extending in a direction aligned with the longitudinal axis extending from the forward portion to the rearward portion. The central axis is approximately aligned with the midline of the sole plate, and the central axis divides the sole plate into two opposing sides along the lateral axis. The two sides of the sole plate comprise a first side and a second side, and the forward portion is disposed substantially toward the first side relative to the rearward portion, such that the forward portion and the rearward portion are laterally offset with respect to one another.

In another aspect, the present disclosure is directed to a sole plate for an article of footwear, comprising a forward portion, an intermediate portion, and a rearward portion, and a longitudinal axis, a lateral axis, and a midline. There is a compartment disposed within the intermediate portion, where the compartment comprises a cavity. Furthermore, there is a central axis extending in a direction aligned with the longitudinal axis extending from the forward portion to the rearward portion, the central axis being approximately aligned with the midline of the sole plate. The central axis divides the sole plate into two opposing sides along the lateral axis, and the two sides of the sole plate comprise a first side and a second side. The forward portion extends a first distance from the central axis toward the first side, the rearward portion extends a second distance from the central axis toward the second side, and the first distance is greater than the second distance.

In another aspect, the present disclosure is directed to a sole structure for an article of footwear, comprising a forefoot region, a heel region, a longitudinal axis, a lateral axis, and a midline, and a central axis extending in a direction aligned with the longitudinal axis extending from the forefoot region to the heel region. The central axis is approximately aligned with the midline of the sole structure, and the central axis divides the sole structure into two opposing sides along the lateral axis. The two sides of the sole structure comprise a first side and a second side. Furthermore, the sole structure includes a sole plate and a midsole, where the sole plate is disposed adjacent to the midsole, and where the sole plate includes a forward portion, an intermediate portion, and a rearward portion. A compartment is disposed along the intermediate portion, and the compartment comprises a cavity. In addition, the midsole includes a first portion, a bridge portion, and a second portion, where the midsole includes two open regions associated with the bridge portion, and where the two open regions include a first open region and a second open region. The bridge portion is disposed adjacent to a portion of the intermediate portion, where the first open region creates a first exposed area of the cavity toward the first side, where the second open region creates a second exposed area of the cavity substantially toward the second side, and where a size of the first exposed area is smaller than a size of the second exposed area.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
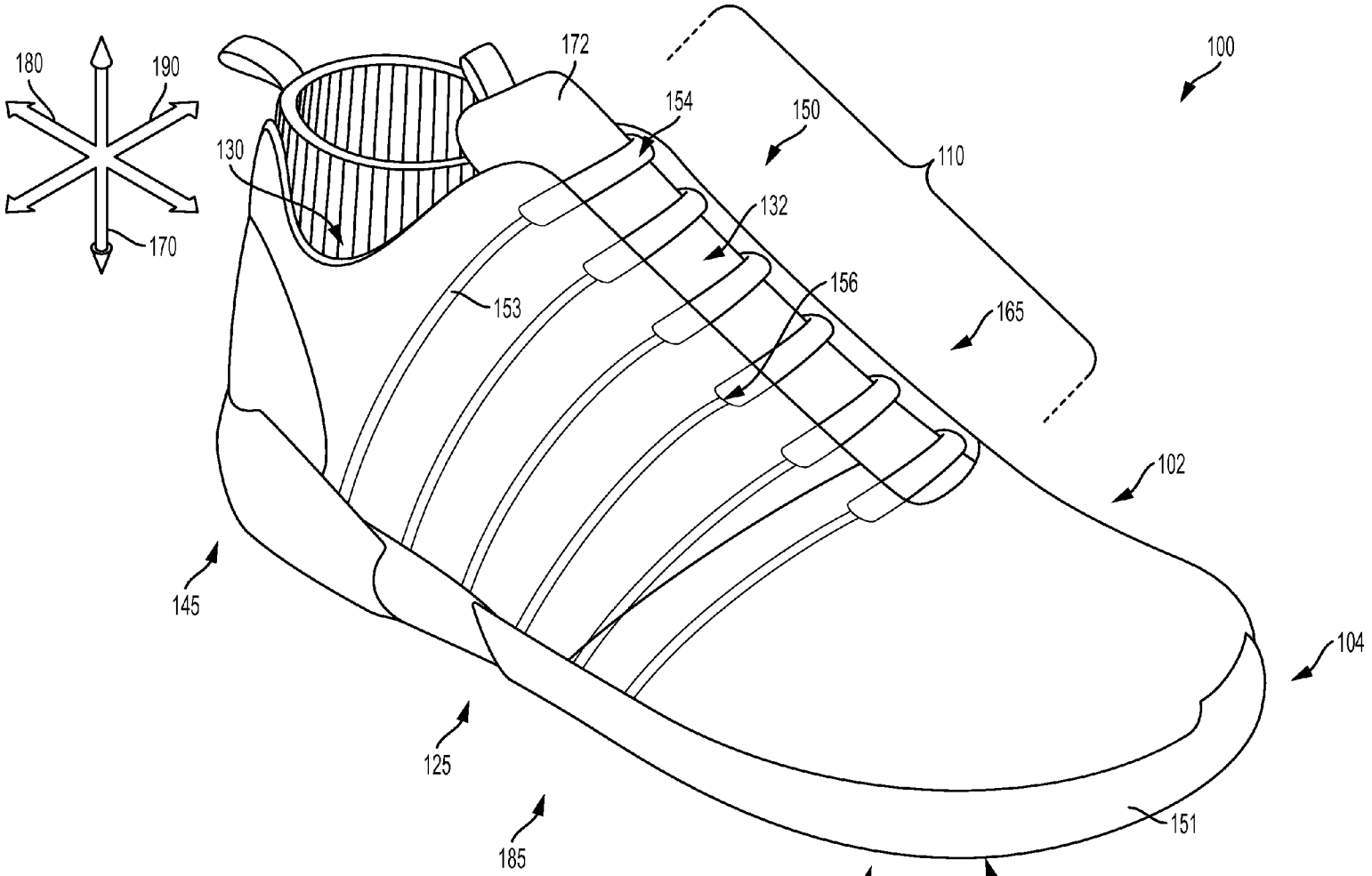
FIG. 1 is a schematic isometric side view of an embodiment of an article of footwear.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

FIG. 1 illustrates a schematic isometric view of an embodiment of article of footwear 100 that is configured with a tensioning system 150. In the current embodiment, article of footwear 100, also referred to hereafter simply as article 100, is shown in the form of an athletic shoe, such as a running shoe. However, in other embodiments, tensioning system 150 may be used with any other kind of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear. As discussed in further detail below, a tensioning system may not be limited to footwear and in other embodiments a tensioning system and/or components associated with a tensioning system could be used with various kinds of apparel, including clothing, sportswear, sporting equipment and other kinds of apparel. In still other embodiments, a tensioning system may be used with braces, such as medical braces.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100, but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

As shown in FIG. 1, upper 102 may include one or more material elements (for example, meshes, textiles, foam, leather, and synthetic leather), which may be joined to define an interior void configured to receive a foot of a wearer. The material elements may be selected and arranged to impart properties such as light weight, durability, air-permeability, wear-resistance, flexibility, and comfort. Upper 102 may define an opening 130 through which a foot of a wearer may be received into the interior void.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is harder or softer. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with a ground surface.

In some embodiments, sole structure 104 may include multiple components, which may individually or collectively provide article 100 with a number of attributes, such as support, rigidity, flexibility, stability, cushioning, comfort, reduced weight, or other attributes. In some embodiments, sole structure 104 may include an insole/sockliner, a midsole 151, and a ground-contacting outer sole member ("outsole") 162, which may have an exposed, ground-contacting lower surface. In some cases, however, one or more of these components may be omitted. In one embodiment, sole structure 104 may comprise a sole plate, as will be further discussed below.

Furthermore, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

Midsole 151 may be fixedly attached to a lower area of upper 102, for example, through stitching, adhesive bonding, thermal bonding (such as welding), or other techniques, or may be integral with upper 102. Midsole 151 may be formed from any suitable material having the properties described above, according to the activity for which article 100 is intended. In some embodiments, midsole 151 may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

Midsole 151 may extend through each of forefoot region 105, midfoot region 125, and heel region 145, and between lateral side 185 and medial side 165 of article 100. In some embodiments, portions of midsole 151 may be exposed around the periphery of article 100, as shown in FIG. 1. In other embodiments, midsole 151 may be completely covered by other elements, such as material layers from upper 102. For example, in some embodiments, midsole 151 and/or other portions of upper 102 may be disposed adjacent to a bootie (see FIGS. 3 and 4).

Furthermore, as shown in FIG. 1, article 100 may include a tongue 172, which may be provided near or along a throat opening 132. In some embodiments, tongue 172 may be provided in or near an instep region 110 of article 100. However, in other embodiments, tongue 172 may be disposed along other portions of an article of footwear, or an article may not include a tongue.

In addition, as noted above, in different embodiments, article 100 may include a tensioning system 150. Tensioning system 150 may comprise various components and systems for adjusting the size of an opening 130 leading to an interior void (see FIG. 2) and tightening (or loosening) upper 102 around a wearer's foot. Some examples of different tensioning systems that can be used are disclosed in Beers et al., U.S. Patent Publication Number 2014/0070042 published Mar. 13, 2014, (previously U.S. patent application Ser. No. 14/014,555, filed Aug. 30, 2013) and entitled "Motorized Tensioning System with Sensors" and Beers et al., U.S. Pat. No. 8,056,269, issued Nov. 15, 2011 (previously U.S. Patent Publication Number 2009/0272013, published Nov. 5, 2009) and entitled "Article of Footwear with Lighting System" the entire disclosures of which are incorporated herein by reference.

In some embodiments, tensioning system 150 may comprise one or more laces, as well as a motorized tensioning device. A lace may be configured to pass through various lacing guides 154, which may be further associated with the edges of a throat opening 132. In some cases, lacing guides 154 may provide a similar function to traditional eyelets on uppers. In particular, as a lace is pulled or tensioned, throat opening 132 may generally constrict so that upper 102 is tightened around a foot.

The arrangement of lacing guides 154 in FIG. 1 is only intended to be exemplary and it will be understood that other embodiments are not limited to a particular configuration for lacing guides 154. Furthermore, the particular types of lacing guides 154 illustrated in the embodiments are also exemplary and other embodiments may incorporate any other kinds of lacing guides or similar lacing provisions. In some other embodiments, for example, laces could be inserted through traditional eyelets. Some examples of lace guiding provisions that may be incorporated into the embodiments are disclosed in Cotterman et al., U.S. Patent Application Publication Number 2012/0000091, published Jan. 5, 2012 and entitled "Lace Guide," the disclosure of which is incorporated herein by reference in its entirety. Additional examples are disclosed in Goodman et al., U.S. Patent Application Publication Number 2011/0266384, published Nov. 3, 2011 and entitled "Reel Based Lacing System", the disclosure of which is incorporated herein by reference in its entirety. Still additional examples of lace guides are disclosed in Kerns et al., U.S. Patent Application Publication Number 2011/0225843, published Sep. 22, 2011 and entitled "Guides For Lacing Systems," the disclosure of which is incorporated herein by reference in its entirety.

A lace as used with article 100 may comprise any type of type of lacing material known in the art. Examples of laces that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township N.J., although other kinds of extended chain, high modulus polyethylene fiber materials can also be used as a lace. Still further exemplary properties of a lace can be found in the Reel Based Lacing Application mentioned above.

Thus, in some embodiments, a lace may be passed through lacing guides 154. In other embodiments, a lace may pass through internal channels 153 within upper 102 after entering channel openings 156 that are near lacing guides 154. In some embodiments, internal channels 153 extend around the sides of upper 102 and guide the lace towards a motorized tensioning device disposed in sole structure 104. In some cases, the motorized tensioning device may include provisions for receiving portions of a lace. In some cases, end portions of the lace can exit internal channels 153 of upper 102 and can pass through apertures in a housing unit that contains a motorized tensioning device.

In some embodiments, a motorized tensioning device may generally be configured to automatically apply tension to a lace for purposes of tightening and loosening upper 102. A motorized tensioning device may thus include provisions for winding a lace onto, and unwinding a lace from, a spool internal to the motorized tensioning device. Moreover, the provisions may include an electric motor that automatically winds and unwinds the spool in response to various inputs or controls.

Some embodiments may include one or more compartments disposed throughout various portions of article 100. For purposes of this disclosure, a compartment refers to a separate or distinct section or portion of article 100. In some embodiments, a compartment can include a sleeve-like region, a tunnel or tubing disposed within article 100, and/or a recess, cavity, pocket, chamber, slot, pouch, or other space configured to receive an object, element, or component. In some embodiments, during manufacture of article 100, one or more compartments can be included in article 100, as will be discussed below.

Figure 2:
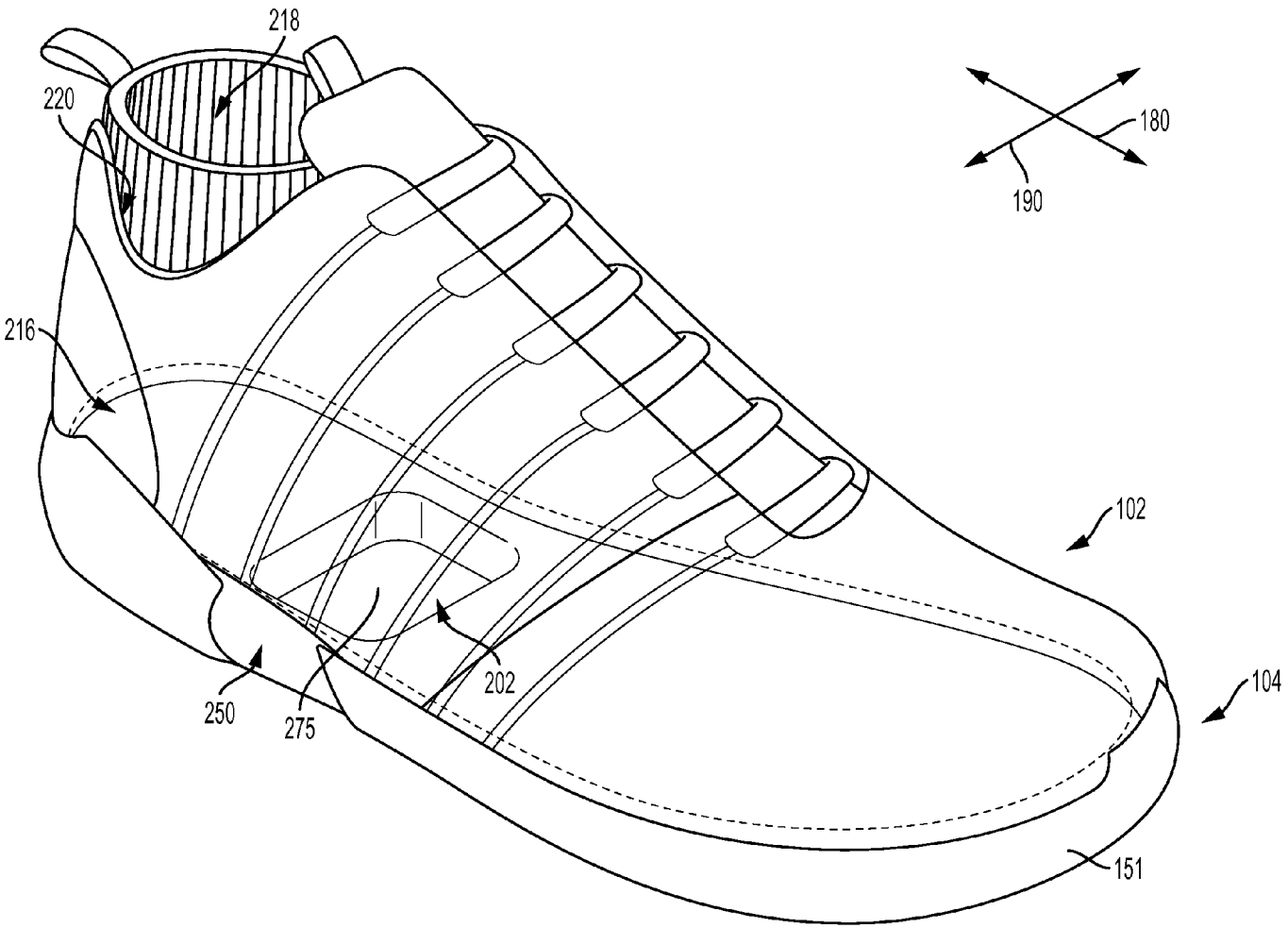
FIG. 2 is a schematic cutaway view of an embodiment of an article of footwear.

Referring to FIG. 2, an isometric side view of article 100 is illustrated with a transparent view to reveal a portion of an interior void 218. FIG. 2 includes a depiction of an embodiment of a compartment 202, disposed within a portion of sole structure 104. In some embodiments, sole structure 104 can include a sole plate 250. In some embodiments, midsole 151 may be disposed adjacent to or receive sole plate 250. In one embodiment, compartment 202 may be formed within sole plate 250.

In some embodiments, a compartment may be designed, dimensioned, or configured to receive different types of components or elements. For example, compartment 202, which is associated with sole plate 250, comprises a cavity 275, and is disposed underneath an optional insole 216 (depicted here with a dotted line). In other words, in different embodiments, article 100 may include different regions configured for the insertion or installation of other objects, elements, or components.

Furthermore, it should be understood that the embodiments described herein with respect to compartment 202 in FIG. 2 may be applicable to articles that do not include a tensioning system. In other words, sole plate 250 may be utilized in any type or configuration of footwear or article of apparel.

Figure 3:
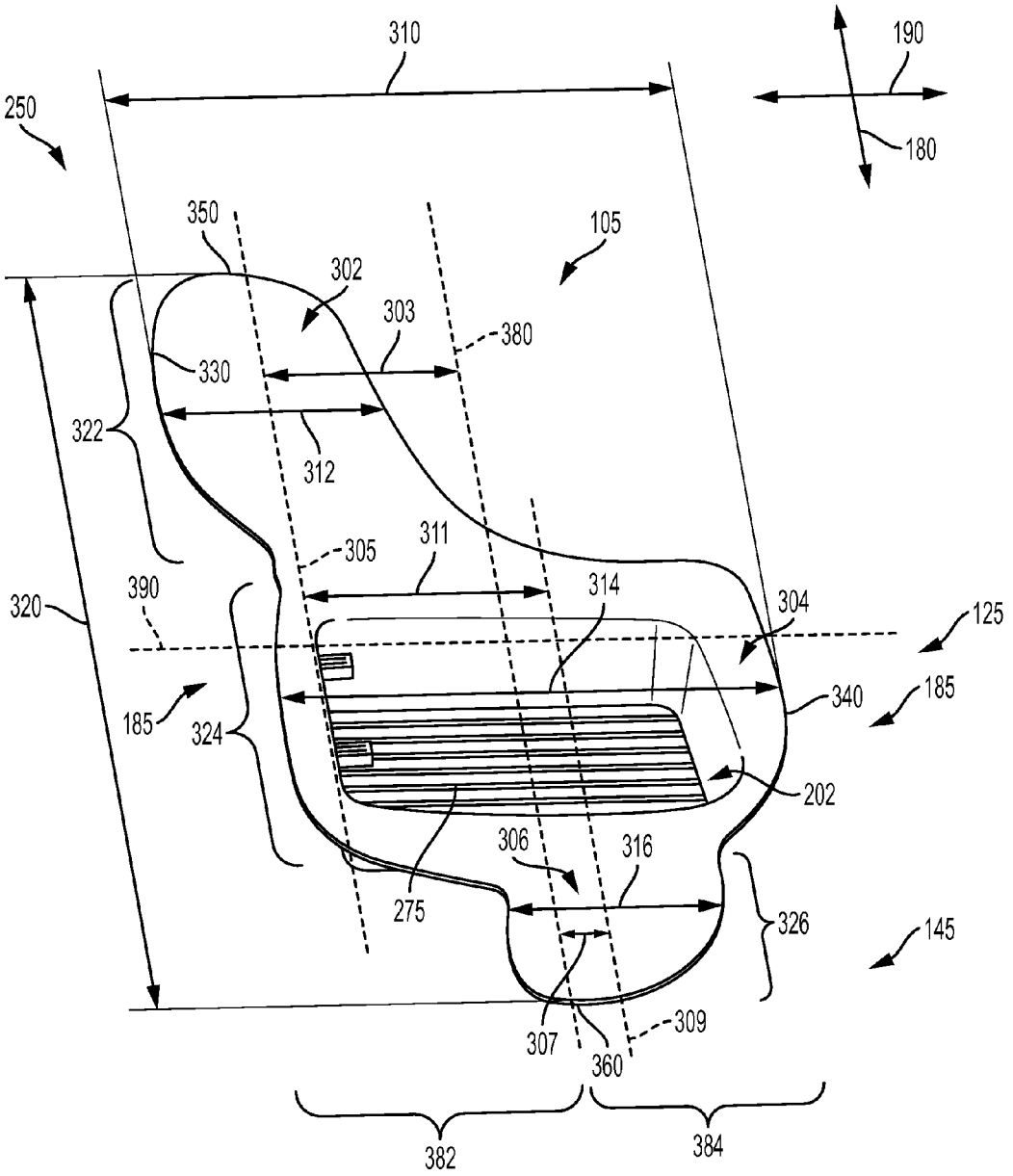
FIG. 3 is a schematic isometric view of an embodiment of a sole plate.
Figure 4:
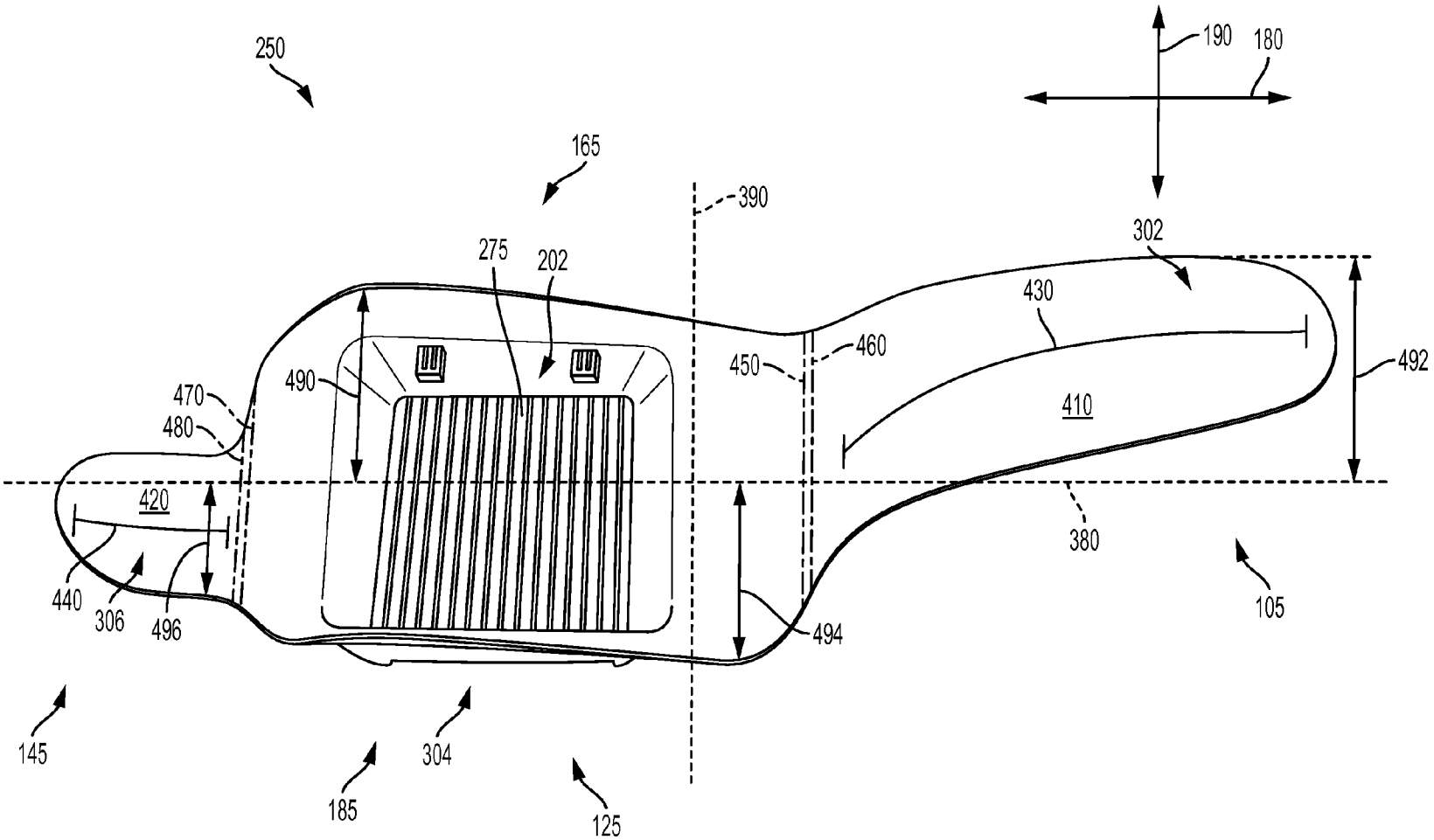
FIG. 4 is a schematic isometric top view of an embodiment of a sole plate.

In order to provide the reader with greater understanding of the proposed embodiments, two views are depicted of sole plate 250 in FIGS. 3 and 4. In FIG. 3, a front isometric view of an embodiment of sole plate 250 is illustrated, and in FIG. 4, a top-down isometric view of an embodiment of sole plate 250 is illustrated. Sole plate 250 can include different regions or sections in some embodiments. As shown in FIGS. 3-4, for purposes of reference, sole plate 250 may be divided into a forward portion 302, an intermediate portion 304, and a rearward portion 306. In different embodiments, the shape of sole plate 250 can vary. In one embodiment, the shape of sole plate 250 may resemble a generally oblong shape comprising forward portion 302, joined to a substantially rectangular shape comprising intermediate portion 304, which is joined to a substantially oblong shape comprising rearward portion 306. In other embodiments, the perimeter and shape of different portions of sole plate 250 may vary from what is depicted here, and include any regular or irregular shape.

In some embodiments, portions of sole plate 250 may comprise a substantially flat or two-dimensional material or structure. The term "two-dimensional" as used throughout this detailed description and in the claims refers to any generally flat material exhibiting a length and width that are substantially greater than a thickness of the material.

Figure 7:
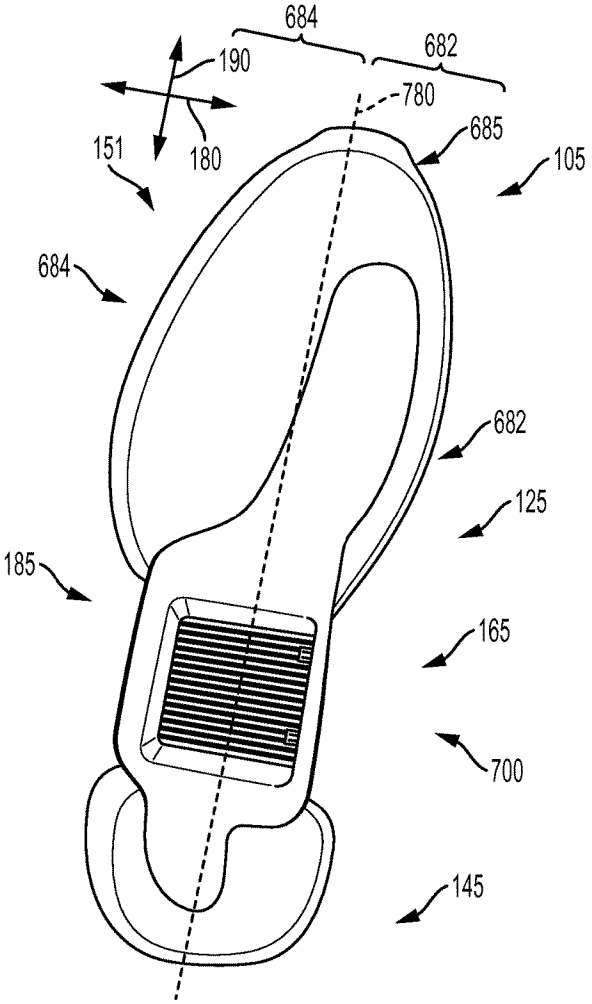
FIG. 7 is a schematic top view of an embodiment of a midsole and a sole plate.
Figure 6:
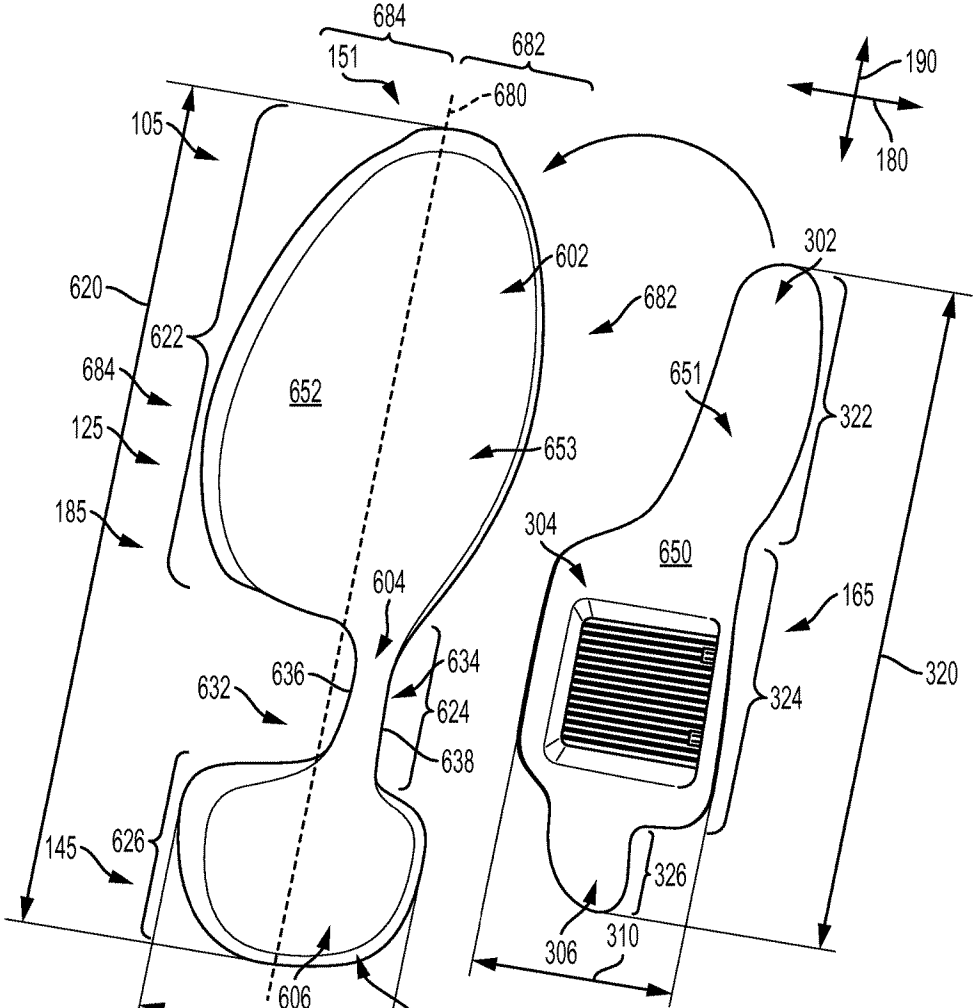
FIG. 6 is a schematic top view of an embodiment of a midsole and a sole plate.

Although two-dimensional materials may have smooth or generally untextured surfaces, some two-dimensional materials will exhibit textures or other surface characteristics, such as dimpling, protrusions, ribs, or various patterns, for example. In other embodiments, the geometry of sole plate 250 could vary and could include various contours or features associated with parts of a foot, for example, the sole region of a foot. It should also be understood that in some embodiments, sole plate 250 may be disposed along a midsole in an asymmetrical manner, as shown in FIGS. 6 and 7 below.

Furthermore, in some embodiments, sole plate 250 and other components of sole structure 104 can be formed of various material compositions. In some embodiments, sole plate 250 can be associated with a higher stiffness or hardness than upper 102. In one embodiment, sole plate 250 is at least partially formed of thermoplastic polyurethane (TPU). In other embodiments, sole plate 250 may comprise a glass-filled nylon material. In still other embodiments, sole plate 250 may comprise a glass-filled TPU. In some embodiments, sole plate 250 may comprise a light-diffusive material, as will be discussed below with respect to FIG. 13.

In FIGS. 3-4, for purposes of reference, a central longitudinal axis 380 and a central lateral axis 390 are depicted superimposed over the illustration of sole plate 250. It should be understood that central longitudinal axis 380 is arranged to generally bisect sole plate 250 along a midline aligned with longitudinal axis 180, and central lateral axis 390 is arranged to generally bisect sole plate 250 along a midline aligned with lateral axis 190.

To appreciate the dimensions of sole plate 250, it can be seen that sole plate 250 has a plate width 310 and a plate length 320. Plate width 310 extends from a first end 330 associated with medial side 165 of forward portion 302 to a second end 340 associated with lateral side 185 of intermediate portion 304. Plate length 350 extends from a third end 350 associated with a foremost tip of forward portion 302 to a fourth end 360 associated with a rearmost tip of rearward portion 306.

Plate width 310 can be seen to include or encompass a first width 312, a second width 314, and a third width 316. First width 312 is associated with the maximum width of forward portion 302, second width 314 is associated with the maximum width of intermediate portion 304, and third width 316 is associated with the maximum width of rearward portion 306. In addition, plate length 320 can be seen to include a first length 322, a second length 324, and a third length 326. First length 322 is associated with the maximum length of forward portion 302, second length 324 is associated with the maximum length of intermediate portion 304, and third length 326 is associated with the maximum length of rearward portion 306.

As shown in FIGS. 3 and 4, in some embodiments, second width 314 may be greater than either first width 312 or third width 316. Furthermore, first width 312 can be greater than third width 316. In some embodiments, first length 322 may be greater than either second length 324 or third length 326. In addition, first length 322 and third length 326 may be substantially dissimilar, while first length 322 and second length 324 may be relatively closer in length. Thus, first length 322 of forward portion 302 may be significantly longer than third length 326 of rearward portion 306 in some embodiments. In different embodiments, the dimensions of sole plate 250 can vary. For example, first length 322 may be less than either second length 324 or third length 326 in some embodiments. In other embodiments, second width 314 may be less than either first width 312 or third width 316.

It can also be noted that in some embodiments, forward portion 302 and rearward portion 306 may be disposed to form varying arrangements relative to intermediate portion 304. Referring to FIGS. 3 and 4, forward portion 302 is arranged such that it is substantially disposed along medial side 165 of sole plate 250. In addition, rearward portion 306 is arranged such that it is substantially disposed along lateral side 185 of sole plate 250. In other words, as illustrated in FIG. 3, if it is understood that central longitudinal axis 380 represents a longitudinal midline of sole plate 250, forward portion 302 can be disposed along a first side 382, and rearward portion 306 can be disposed along a second side 384. In other words, forward portion 302 and rearward portion 306 may be laterally offset.

Furthermore, referring to FIG. 3, it can be seen that a forward central longitudinal axis 305 associated with a longitudinal midline of forward portion 302 is disposed along first side 382, and a rearward central longitudinal axis 309 associated with a longitudinal midline of rearward portion 306 is disposed along second side 384. In some embodiments, forward central longitudinal axis 305 can extend further from central longitudinal axis 380 toward first side 382 than rearward central longitudinal axis 309 extends from central longitudinal axis 380 toward second side 384. For example, in FIG. 3, forward central longitudinal axis 305 is disposed a first distance 303 from central longitudinal axis 380 along a direction aligned with lateral axis 190. Furthermore, rearward central longitudinal axis 309 is disposed a second distance 307 from central longitudinal axis 380 along a direction aligned with lateral axis 190. In some embodiments, first distance 303 may be different than second distance 307. In the embodiment of FIG. 3, first distance 303 is substantially greater than second distance 307. In other embodiments, second distance 307 may be substantially greater than first distance 303. Thus, in some embodiments, the separation between the central longitudinal axes associated with forward portion 302 and rearward portion 306 can be greater than the separation of either of the central axes (represented by forward central longitudinal axis 305 and rearward central longitudinal axis 309) from central longitudinal axis 380 along a lateral direction. Thus, in FIG. 3, a third distance 311 associated with the distance between forward central longitudinal axis 305 and rearward central longitudinal axis 309 in a direction aligned with lateral axis 190 is greater than either first distance 303 or second distance 307.

In some embodiments, the lateral offset arrangement can enhance the torsional rigidity of sole plate 250. Thus, in some cases, forward portion 302 can provide a stabilizing plate portion within sole plate 250. Similarly, in other cases, rearward portion 306 may provide a stabilizing plate portion within sole plate 250. In some embodiments, forward portion 302 and/or rearward portion 306 can increase the stability of sole plate 250 when incorporated into a sole structure.

Furthermore, intermediate portion 304 can be disposed to extend between or across both first side 382 and second side 384. In addition, it can be seen that forward portion 302 may be joined to intermediate portion 304 in a different manner than rearward portion 306. In FIG. 4, while a first border 450 of intermediate portion 304 is joined in a manner that is substantially continuous with a second border 460 of forward portion 302, a third border 470 of intermediate portion 304 is only partially joined to a fourth border 480 of rearward portion 306. In other words, rearward portion 306 extends from third border 470 such that a portion of third border 470 remains separate and/or unattached to any additional sole plate portion. However, forward portion 302 has been arranged such that first border 450 flows or merges in a substantially contiguous manner with second border 460, and first border 450 and second border 460 form a common border. It should be understood by the reader that the labels applied herein (such as first border 450, second border 460, third border 470, fourth border 480) are for illustrate purposes only and do not necessarily demarcate specific regions of sole plate 250.

Thus, in different embodiments, different portions of sole plate 250 may be asymmetrical with respect to one another, relative to a central axis. For purposes of this description, the term "asymmetrical" and "asymmetric" are used to characterize regions of a sole component or articles. As used herein, two regions of a sole component have a symmetric configuration when the regions have a symmetry about some common axis. In contrast, two regions of a sole component have an asymmetric configuration when there is no axis about which the sole members have a symmetry. It may be further understood that the characterizations of symmetric and asymmetric may be with reference to all features of the sole component, or with reference to only some subset of features. In particular, given a feature of a sole component, two or more regions of the sole component may be considered as symmetric or asymmetric only with respect to that feature. In the following embodiments, for example, specific consideration is given of the asymmetry of the various portions of sole plate 250 with respect to a particular axis. It should further be understood that while a sole component may generally include some level of asymmetry, the asymmetry described herein may be primarily directed to any asymmetry in the position and/or orientation of the arrangement of portions of sole plate 250 (in particular, of forward portion 302 and rearward portion 306).

Furthermore, referring to FIG. 4, there may be differences in the overall size of forward portion 302 relative to rearward portion 306. For example, forward portion 302 may comprise a first area 410, and rearward portion 306 may comprise a second area 420. In different embodiments, first area 410 may differ from second area 420. In some embodiments, the area associated with first area 410 may be larger than the area associated with second area 420. In FIG. 4, first area 410 is significantly larger in area than second area 420. Thus, forward portion 302 may be understood to comprise a greater proportion of sole plate 250 than rearward portion 306 in some embodiments. However, it should be understood that in other embodiments, first area 410 and second area 420 may be substantially similar, or second area 420 may be larger in area than first area 410.

In addition, as shown in FIG. 4, there may be differences in the curvature or geometry of forward portion 302 relative to rearward portion 306. For purposes of this disclosure, the curvature associated with a component or portion represents the degree to which its geometry along an axis deviates from a straight line. In FIG. 4, the overall curvature of forward portion 302 that extends in a direction generally aligned with longitudinal axis 180 is identified by a first curved axis 430. Similarly, the overall curvature of rearward portion 306 that extends in a direction generally aligned with longitudinal axis 180 is identified by a second curved axis 440. In some embodiments, first curved axis 430 may differ from second curved axis 440.

In some embodiments, for example, the degree of curvature associated with first curved axis 430 may be larger than second curved axis 440. In FIG. 4, first curved axis 430 has a substantially greater degree of curvature than second curved axis 440. Thus, forward portion 302 may be understood to comprise a less regular or linear region than rearward portion 306 in some embodiments. In other words, rearward portion 306 may be more linear relative to the arrangement of forward portion 302. However, it should be understood that in other embodiments, first curved axis 430 and second curved axis 440 may be substantially similar, or second curved axis 440 may have a greater curvature than first curved axis 430.

Furthermore, as shown in FIG. 4, forward portion 302 may be arranged such that it extends beyond the maximum width (i.e., second width 314) of intermediate portion 304 along medial side 165. In other words, while intermediate portion 304 can extend a first distance 490 toward medial side 165, forward portion 302 can extend a second distance 492 towards medial side 165. In some embodiments, second distance 492 may be greater than first distance 490. Thus, forward portion 302 may be disposed to extend further toward medial side 165 from central longitudinal axis 380 than intermediate portion 304 in one embodiment.

In some embodiments, rearward portion 306 may be arranged such that it extends less than the maximum width (i.e., second width 314) of intermediate portion 304 along lateral side 185. In some cases, rearward portion 306 may be disposed more centrally relative to forward portion 302. For example, in FIG. 4, intermediate portion 304 extends a third distance 494 toward lateral side 185, while rearward portion 306 extends a fourth distance 496 toward lateral side 185. In other words, while both intermediate portion 304 and rearward portion 306 are at least partially disposed along lateral side 185, intermediate portion 304 may extend further toward lateral side 185 relative to central longitudinal axis 380. Thus, in some embodiments, third distance 494 can be greater than fourth distance 496.

However, it should be understood that in other embodiments, first distance 490 and second distance 492 may be substantially similar, or first distance 490 may be greater than second distance 492. Similarly, in some embodiments, third distance 494 and fourth distance 496 may be substantially similar, or third distance 494 may be less than fourth distance 496. It should further be understood by the reader that the labels applied herein (such as first distance 490, second distance 492, third distance 494, fourth distance 496) are for illustrate purposes only and do not necessarily demarcate specific dimensions of sole plate 250.

Figure 5:
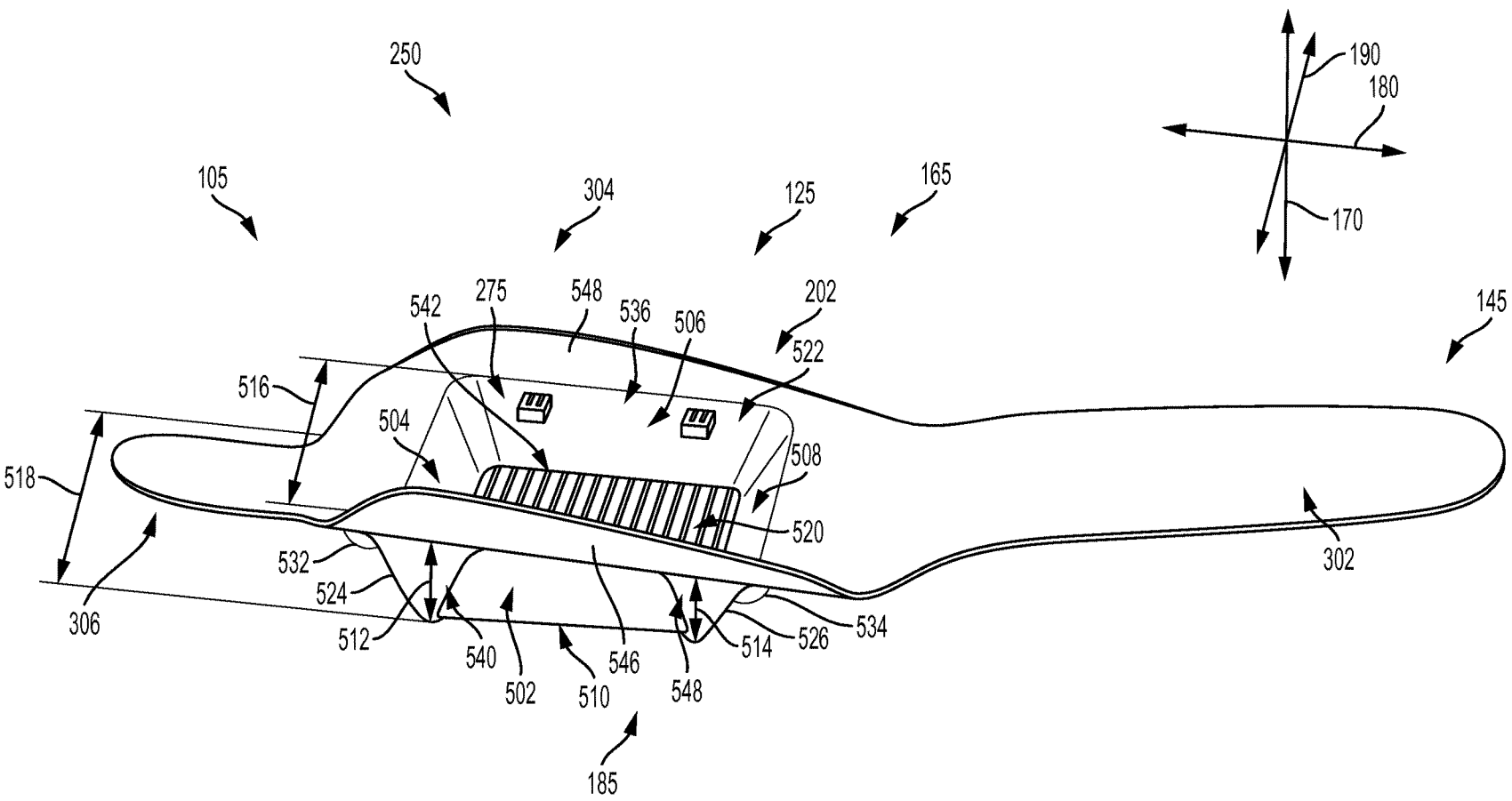
FIG. 5 is a schematic isometric side view of an embodiment of a sole plate.

Referring now to FIG. 5, a side isometric view of an embodiment of sole plate 250 is depicted. As noted earlier with respect to FIG. 2, sole plate 250 includes a compartment 202. Compartment 202 includes a cavity 275 defined by a series of sidewalls and a base. In FIG. 5, cavity 275 comprises a first sidewall 502, a second sidewall 504, a third sidewall 506, and a fourth sidewall 508, as well as a base portion 510. In different embodiments, the dimensions and/or shape associated with the regions of cavity 275 can vary with respect to each other. In some embodiments, first sidewall 502 can include an upper length 512 and a lower length 514. Furthermore, second sidewall 504 can include an upper width 516 and a lower width 518. In some embodiments, upper length 512 may be different from upper width 516. In one embodiment, upper length 512 is greater than upper width 516, as shown in FIG. 5. However, in other embodiments, upper length 512 may be substantially similar or less than upper width 516. In some embodiments, the dimensions of third sidewall 506 may be substantially similar to the dimensions of first sidewall 502. Similarly, in some embodiments, the dimensions of fourth sidewall 508 may be substantially similar to the dimensions of second sidewall 504. However, in other embodiments, the dimensions of each sidewall may differ from one another.

Furthermore, in one embodiment, first sidewall 502 and/or third sidewall 506 can generally extend along a direction aligned with lateral axis 190. In another embodiment, fourth sidewall 508 and/or second sidewall 504 can generally extend along a direction aligned with longitudinal axis 180. As a result, in some cases, cavity 275 may include a substantially rectangular prism shape, where sidewalls that lie along a similar axis (i.e., sidewalls that are substantially parallel) are also generally matched in shape and size. However, in other embodiments, the perimeter and shape of different portions of cavity 275 may vary from what is depicted here, and include any regular or irregular shape, including three-dimensional rectangular, square, elliptical, oval, round shapes.

In different embodiments, the orientation of each sidewall may differ from one another, such that cavity 275 has a less regular three-dimensional shape. For example, the edges of one or more sidewalls may extend in a diagonal direction. In FIG. 5, a first edge 524 of first sidewall 502 is oriented at a first angle 532 relative to vertical axis 170, and a second edge 526 of first sidewall 502 is oriented at a second angle 534 relative to vertical axis 170. In some embodiments, first angle 532 and/or second angle 534 may be acute angles. In other embodiments, first angle 532 and/or second angle 534 may be obtuse angles. In one embodiment, first angle 532 and/or second angle 534 may be right angles.

Thus, in some embodiments, cavity 275 may comprise a substantially quadrilateral frustum (apex-truncated square pyramid) shaped recess. In other embodiments, cavity 275 may be a substantially three-dimensional rectangular shape, where one side remains open. More simply, base portion 510 may have a first area 520, and an opening 536 leading into cavity 275 bounded by the upper edges of the sidewalls may have a second area 522, and first area 520 and second area 522 may differ. In one embodiment, first area 520 may be less than second area 522, such that the adjoining edges of sidewalls taper inward toward a center of the cavity. In another embodiment, first area 520 may be greater than second area, such that the adjoining edges of sidewalls extend outward toward the perimeter of intermediate portion 304. This shape can improve the fit of intermediate portion 304 within a midsole or other sole component in some embodiments. In addition, the shape associated with cavity 275 can be configured to snugly receive, accommodate, and/or better secure a specific component (such as motorized tensioning device 160 in FIG. 1) in one embodiment.

Furthermore, in some embodiments, there may be triangular or pyramidal portions disposed along one or more regions of cavity 275. For example, in FIG. 5, first sidewall 502 includes a forward triangular portion 538 and a rear triangular portion 540. Triangular portions may also be included along other sidewalls, such as along opposing third sidewall 506. The geometry of the triangular portions can increase the stability of intermediate portion 304, as well as of sole plate 250. In addition, the triangular portions can act to provide better grip when sole plate 250 is placed on a surface. The triangular portions can also be configured for an improved fit within midsole 151 (see FIGS. 6 and 7).

Compartment 202 may also include provisions for holding or securing a component in different embodiments. For example, along base portion 510 of cavity 275 there may be one or more ridges 542. Ridges 542 may form an uneven or undulating surface along at least one side of base portion 510. The use of ridges 542 can increase grip between base portion 510 and a surface of a component in some embodiments. In some cases, ridges 542 may be substantially parallel with respect to one another. In one embodiment, ridges 542 may be oriented along a direction aligned with lateral axis 190.

In addition, sole plate 250 may include provisions for improved contact with other components of article 100 (see FIG.2), and increased stability of sole plate 250 when assembled within sole structure 104. For example, adjacent to opening 536 of cavity 275, compartment 202 includes a first flange 546 and a second flange 548. First flange 546 is disposed to extend generally upward at a diagonal angle from first sidewall 502, and second flange 548 is disposed to extend generally upward at a diagonal angle from third sidewall 506. Thus, first flange 546 is disposed along lateral side 185 of sole plate 250, and second flange 548 is disposed along medial side 165 of sole plate 250. When sole plate 250 is assembled in an article of footware, first flange 546 can create a smooth, continuous surface that extends between cavity 275 and lateral side 185. Similarly, when sole plate 250 is assembled in an article of footware, second flange 548 can create a smooth, continuous surface that extends between cavity 275 and medial side 165. This can also increase comfort for a user when a foot is disposed in interior void 218 (see FIG.2). Furthermore, each flange can be substantially similar in size and geometry to another flange, or be different. For example, first flange 546 can be larger in surface area than second flange 548 in one embodiment. Thus, first flange 546 and second flange 548 may be asymmetric with respect to one another in some embodiments. However, in other embodiments, first flange 546 and second flange 548 may be substantially similar.

Figure 8:
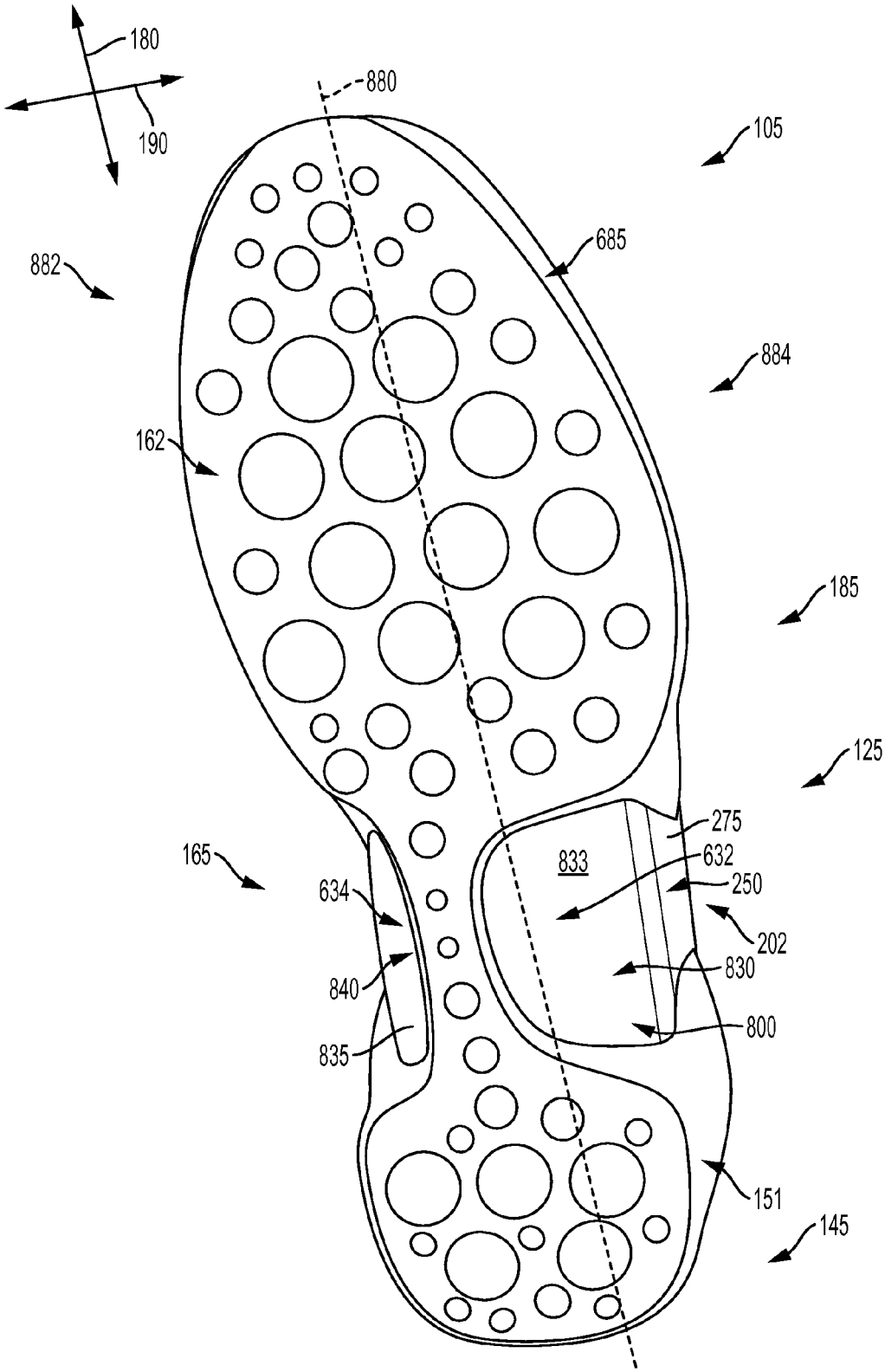
FIG. 8 is an isometric bottom view of an embodiment of an article of footwear.

In different embodiments, sole plate 250 may be assembled, incorporated, joined, or otherwise disposed adjacent to an additional component of article 100. FIGS. 6-8 provide an example of the joining between two components including sole plate 250 and midsole 151. FIG. 6 depicts a top-down view of an embodiment of sole plate 250 and midsole 151. FIG. 7 depicts a top-down view of an embodiment of the receipt of sole plate 250 by midsole 151, forming combined sole layers 700. In FIG. 8, a bottom isometric perspective of sole structure 104 is illustrated, providing a view of a portion of the bottom surface of sole plate 250.

Referring now to FIG. 6, for purposes of reference, midsole 151 may be divided into a first portion 602, a bridge portion 604, and a second portion 606. In different embodiments, the shape of midsole 151 can vary. In one embodiment, the shape of midsole 151 may resemble a generally elliptical or oval shape along first portion 602 and a generally oblong rectangular shape comprising second portion 606, where first portion 602 and second portion 606 are joined along a substantially rectangular shaped bridge portion 604. Bridge portion 604 may be narrow relative to either first portion 602 or second portion 606. In other embodiments, the perimeter and shape of different portions of midsole 151 may vary from what is depicted here, and include any regular or irregular shape.

It can be seen that in some embodiments, sole plate 250 may be generally smaller in size than midsole 151. For example, while sole plate 250 has plate length 320, midsole 151 has a midsole length 620 that is greater than plate length 320. In addition, plate width 310 is smaller than a midsole width 610 associated with a maximum width of midsole 151. Furthermore, a plate area 650 associated with the area of an inner surface side 651 of sole plate 250 may be significantly less than a midsole area 652 associated with the area of an inner surface side 653 of midsole 151, where the inner surface sides represent the side of each sole component that would face a foot when an article including the various sole components is worn. Thus, in some embodiments, midsole 151 may be large enough to receive or accommodate at least a portion of sole plate 250. Furthermore, midsole 151 may include a border panel 685 disposed around the perimeter of midsole 151 that is raised with respect to inner surface side 653. In some cases, midsole 151 (and in particular border panel 685) may form a recessed portion that can be configured to receive or snugly accommodate sole plate 250 or another component.

However, in other embodiments, the relative dimensions of midsole 151 and sole plate 250 may differ from those illustrated here. For example, midsole length 620 may be substantially similar to or less than plate length 320, and midsole width 610 may be substantially similar to or less than plate width 310 in different embodiments. Furthermore, midsole area 652 may be substantially similar to or less than plate area 650 in other embodiments.

In FIG. 6, for purposes of reference, a first central longitudinal axis 680 is depicted superimposed over the illustration of midsole 151. Similarly, a second central longitudinal axis 780 is depicted superimposed over the illustration of combined sole layers 700 in FIG. 7. Furthermore, in FIG. 8, a third central longitudinal axis 880 is depicted superimposed over the illustration of an assembled sole structure. It should be understood that first central longitudinal axis 680 is arranged to generally bisect midsole 151 along a midline aligned with longitudinal axis 180, second central longitudinal axis 780 is arranged to generally bisect combined sole layers 700 along a midline aligned with longitudinal axis 180, and third central longitudinal axis 880 is arranged to generally bisect the assembled sole structure along a midline aligned with longitudinal axis 180.

Referring specifically to bridge portion 604 in FIG. 6, it may be noted that relative to first longitudinal axis 680, bridge portion 604 can be disposed further toward one side versus another side. In other words, bridge portion 604 is arranged such that it is disposed along medial side 165 of midsole 151. In other words, if it is understood that first central longitudinal axis 680 represents a longitudinal midline of midsole 151, bridge portion 604 can be disposed along a first side 682. In other embodiments, bridge portion 604 may be disposed along a second side 684. In other words, bridge portion 604 may be laterally offset with respect to first central longitudinal axis 680. In another embodiment, bridge portion 604 may be disposed more centrally and/or encompass both first side 682 and second side 684.

As a result of the shape and size of bridge portion 604, two open regions may be disposed adjacent to bridge portion 604. In FIG. 6, a first region 632 and a second region 634 are shown. First region 632 is defined by a segment of a perimeter edge of first portion 602 that extends toward lateral side 185, a first edge 636 of bridge portion 604, and a segment of a perimeter edge of second portion 606 that extends toward lateral side 185. In addition, second region 634 is defined by a segment of the perimeter edge of first portion 602 that extends toward medial side 165, a second edge 638 of bridge portion 604, and a segment of the perimeter edge of second portion 606 that extends toward medial side 165. In some embodiments, first region 632 may encompass a larger area than second region 634. For example, in FIG. 6, first region 632 can have a first area and second region 634 can have a second area, where the size of first area is greater than the size of second area. However, in other embodiments, the size of first area may be substantially similar to or less than the size of second area.

When sole plate 250 is disposed or deposited within the recess formed in midsole 151 (i.e., within the boundary formed by border panel 685), as shown in FIG. 7, the configuration of sole plate 250 as discussed in FIGS. 3-4 can be asymmetrically disposed in midsole 151. In some embodiments, for example, forward portion 302 may be arranged further toward first side 682 relative to second central longitudinal axis 780. Furthermore, intermediate portion 304 may be positioned such that it is generally central and is disposed along both first side 682 and second side 684. In addition, rearward portion 306 may be positioned such that it is disposed further toward second side 684 relative to second central longitudinal axis 730. In other words, forward portion 302 and rearward portion 306 can be laterally offset with respect to one another when assembled within midsole 151.

As shown in FIG. 8, the configuration of midsole 151 can also allow portions of the underside of sole plate 250 to remain exposed in the assembled state. For purposes of this disclosure, the underside of sole plate 250 refers to the bottom-facing and/or outward-facing surfaces of sole plate 250 that forms an opposing surface to inner surface side 651 (shown in FIG. 6). Furthermore, the assembled state refers to the state in which the entire sole structure (which can comprise at least sole plate 250 and midsole 151) has been assembled and is ready for use, installation, and/or integration with an upper for an article of footwear.

In FIG. 8, an isometric bottom view of an embodiment of an assembled sole structure is shown. The sole structure includes outsole 162 joined to midsole 151, where midsole 151 is joined to or is disposed adjacent to sole plate 250. In different embodiments, outsole 162 may include a shape and size substantially similar to that of at least a portion of midsole 151. For example, in FIG. 8, it can be seen that outsole 162 covers a large portion of midsole 151. In other embodiments, outsole 162 may comprise a different shape or size. In one embodiment, outsole 162 may cover a smaller portion of midsole 151 than depicted here. In another embodiment, outsole 162 may cover substantially all of the outer surface side (not shown) of midsole 151, where the outer surface side represents the opposing surface of inner surface side 653 (see FIGS. 6 and 7). In other embodiments, outsole 162 may be substantially larger than midsole 151.

In addition, in some embodiments, as noted earlier, sole plate 250 may be at least partially exposed in the assembled sole structure. Referring to FIG. 8, an underside 800 of sole plate 250 is depicted. Underside 800 can include one or more exposed regions. In FIG. 8, sole plate 250 includes two exposed regions, here referred to as a third region 830 and a fourth region 840. In some embodiments, third region 830 can include both a portion of base portion 510 and a portion of first sidewall 502 (identified in FIG. 5). Similarly, in some embodiments, fourth region 840 can include both a portion of base portion 510 and a portion of third sidewall 506 (shown in FIG. 5).

In different embodiments, third region 830 can correspond with first region 632 of midsole 151, and fourth region 840 can correspond with second region 634 of midsole 151. In other words, third region 830 may be defined by the boundary that also surrounds and defines first region 632, and fourth region 840 may be defined by the boundary that also surrounds and defines second region 634. Furthermore, in some embodiments, third region 830 may encompass or comprise a larger area than fourth region 840. For example, in FIG. 8, third region 830 has a third area 833 and fourth region 840 has a fourth area 835, where third area 833 is greater than fourth area 835. In other words, third region 830 and fourth region 840 may be asymmetric with respect to their degree of exposure. Thus, base portion 510 is asymmetrically exposed, where medial side 165 of base portion 510 is less exposed or is smaller in size than lateral side 185 of base portion 510. However, it should be understood that in other embodiments, third area 833 may be substantially similar to or less than fourth area 835. For example, medial side 165 of base portion 510 can be more exposed or be larger in size than lateral side 185 of base portion 510 in some embodiments.

Thus, the arrangement of exposed regions of sole plate 250 may vary. For example, fourth region 840 is arranged such that it is disposed along medial side 165 of the assembled sole structure. In addition, third region 830 is arranged such that it is substantially disposed toward lateral side 185 of the assembled sole structure, though a smaller proportion of third region 830 can also extend into medial side 165. In other words, if it is understood that third central longitudinal axis 880 represents a longitudinal midline of the assembled sole structure, fourth region 840 can be disposed along a first side 882 and third region 830 can be disposed primarily along a second side 884.

Figure 9:
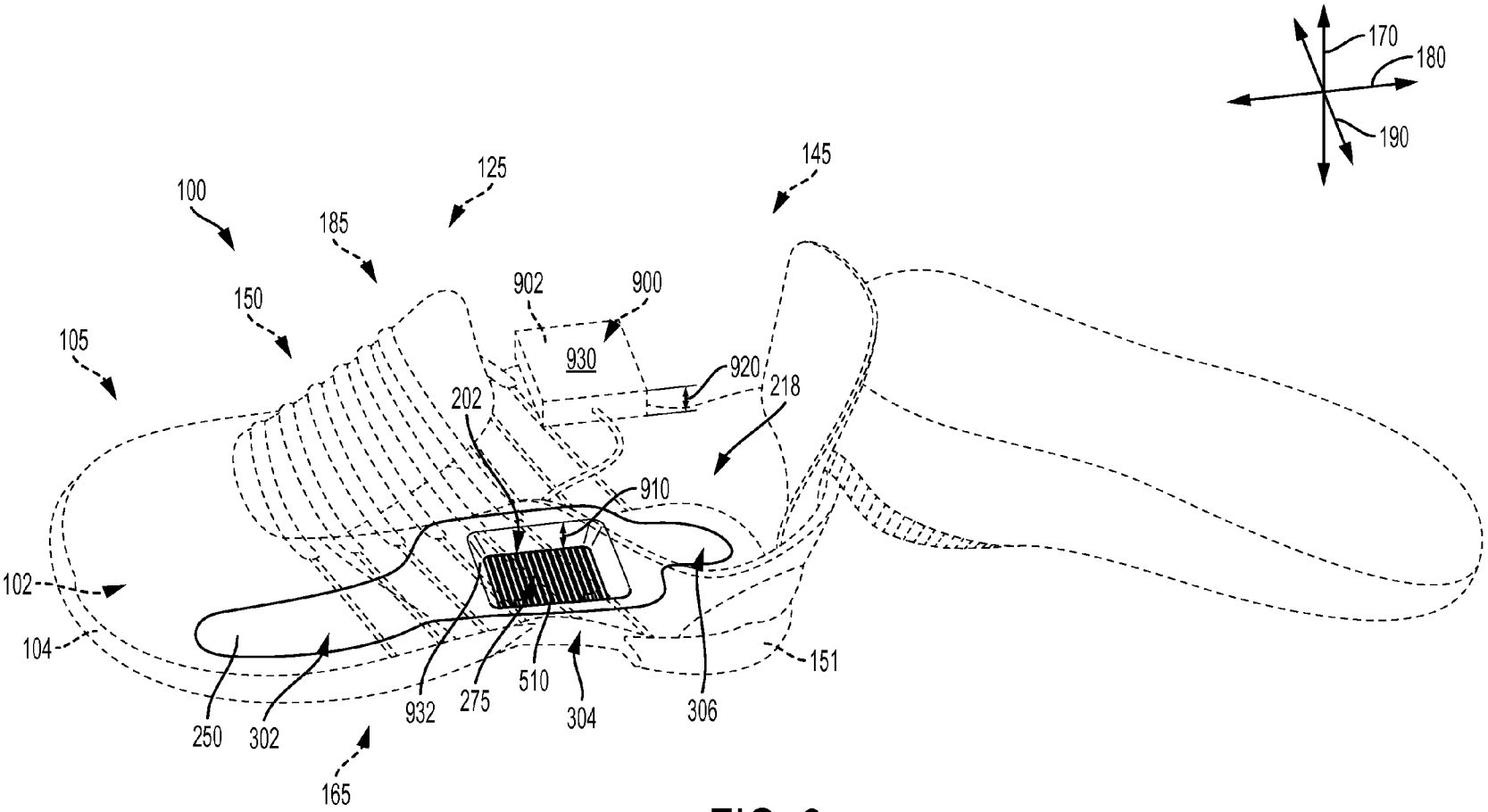
FIG. 9 is a schematic isometric view of an embodiment of a component and an article of footwear.

Referring now to FIG. 9, an embodiment of article 100 is shown. To provide reader with a view of sole plate 250 while sole plate 250 is disposed within article 100, upper 102 is shown in dotted line, and the optional insole is removed to reveal a portion of sole plate 250. In FIG. 9, a component 900 is also illustrated adjacent to article 100. As noted above, one or more components may be installed in article 100. In different embodiments, installation of components may occur after the initial manufacture of article 100, and may be facilitated by the formation of one or more compartments in article 100.

In one embodiment, one or more components may be configured to provide various functions or features to article 100. For example, in FIG. 9, component 900 comprises a housing unit containing motorized tensioning device 160. In other embodiments, different mechanical or electrical components may be included, such as circuitry, textiles, or other materials. As noted above, article 100 may be manufactured to accommodate one or more components in a manner that can allows the ready and secure incorporation of components post-manufacture. In other words, article 100 may include one or more compartments for receiving a component. In the embodiment illustrated in FIG. 9, article 100 may be manufactured such that compartment 202 is configured to receive component 900.

In some embodiments, the housing unit of component 900 may include various mechanisms or elements that can be utilized in tensioning system 150 (see FIG. 1). For example, within the interior of component 900 there may be a battery (or other power source), circuitry (or other control mechanism), spools, gears, a motor, light sources, and/or other mechanisms. However, in other embodiments, the housing unit may have different dimensions and/or shapes. In FIG. 9, component 900 has a substantially three-dimensional rectangular shape.

As noted above, compartment 202 may comprise cavity 275 in sole plate 250. Cavity 275 may be bounded by one or more sidewalls that form a region with an average depth 910 in sole plate 250. In some embodiments, the dimensions of cavity 275 may be designed or configured for secure and/or snug receipt of the housing unit of component 900. In FIG. 9, cavity 275 includes depth 910 greater than a thickness 920 of housing unit of component 900. Furthermore, a first area 930 associated with a first side 902 of component 900 may be less than a second area 932 associated with base portion 510 of cavity 275. In other words, cavity 275 may be dimensioned to at least partially encompass or hold component 900. In some embodiments, for example, second area 932 may be slightly larger than first area 930, such that a substantially snug fit is formed between component 900 and compartment 202. However, in other embodiments, dimensions of either component 900 or compartment 202 may differ such that one is substantially different from the other.

Thus, in some embodiments, component 900 may be easily deposited or inserted into cavity 275 of sole plate 250 without requiring the removal of sole plate 250 from article 100. In other embodiments, however, it may be desirable to remove sole plate 250 before installation of component 900.

Figure 10:
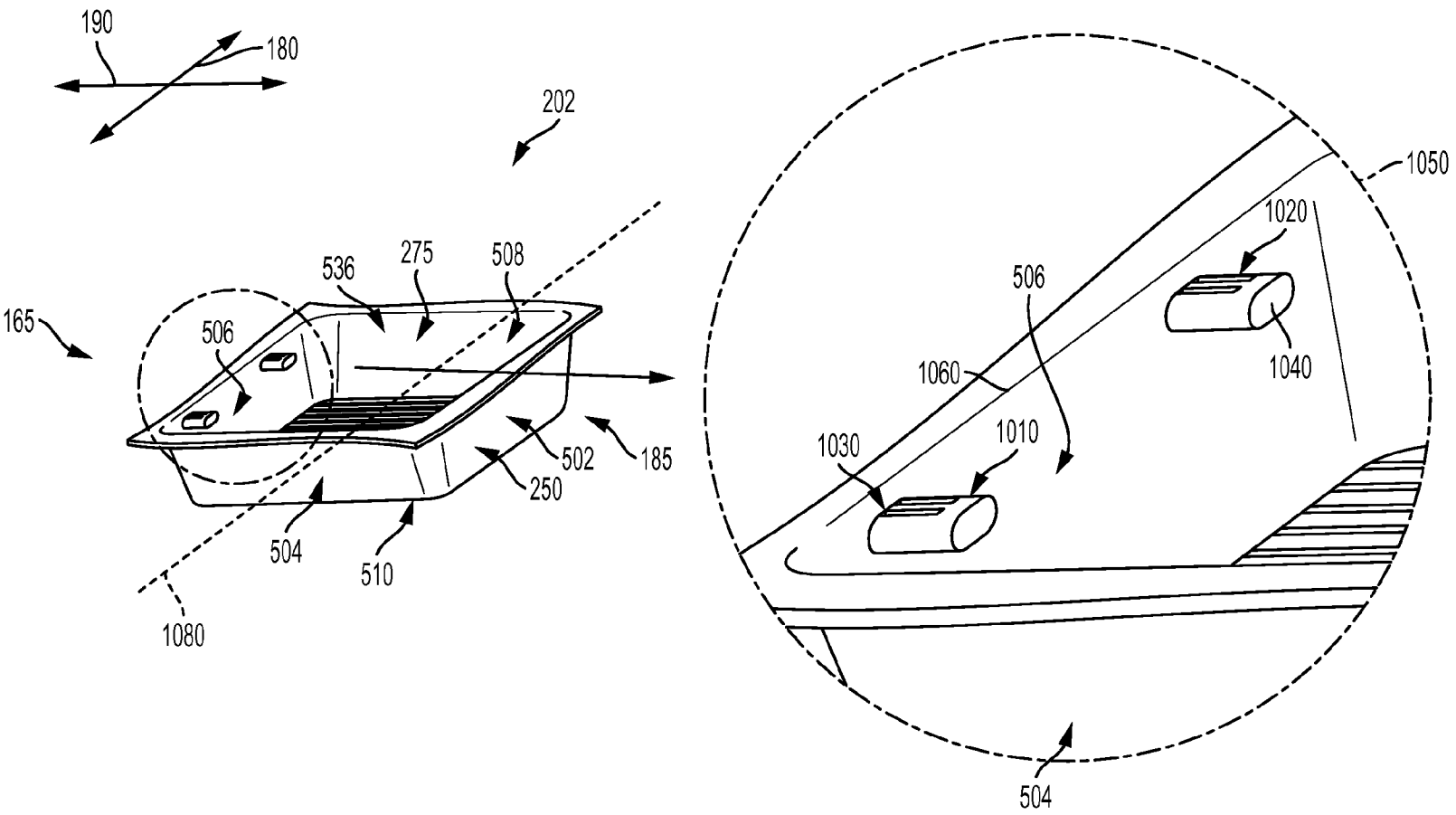
FIG. 10 is a schematic isometric view of an embodiment of a cavity in a sole plate.

In different embodiments, sole plate 250 may include provisions for better engaging with and/or securing component 900. In FIG. 10, an isolated view of cavity 275 is illustrated. As described with respect to FIG. 5, cavity 275 includes first sidewall 502, second sidewall 504, third sidewall 506, fourth sidewall 508, base portion 510, and opening 536. Referring to a magnified view 1050, it can be seen that third sidewall 506 includes two tabs protruding from third sidewall 506, disposed near a third edge 1060. The two tabs may be identified herein as a first tab 1010 and a second tab 1020. First tab 1010 and second tab 1020 are arranged along a direction aligned with a fourth central longitudinal axis 1080. Furthermore, each tab extends inward toward the center of cavity 275.

First tab 1010 and second tab 1020 may each comprise substantially similar lengths and sizes in some embodiments, as shown in FIG. 10. However, in other embodiments, the lengths and/or sizes of tabs may differ with respect to one another. Furthermore, there may be a fewer number or a greater number of tabs in other embodiments. In addition, tabs may be disposed along other regions of cavity 275 in different embodiments. For example, in another embodiment, first tab 1010 may be disposed along first sidewall 502, second sidewall 504, and/or fourth sidewall 508.

First tab 1010 and/or second tab 1020 may include one or more slots 1030 in some embodiments. Slots 1030 may be formed along the surface of first tab 1010 and/or second tab 1020. In one embodiment, slots 1030 may extend from the surface of third sidewall 506 toward a free end 1040 of the tabs. Each tab may include a plurality of slots 1030. In some embodiments, slots 1030 may be arranged around the outer surface of first tab 1010. In FIG. 10, slots 1030 may be spaced apart from their neighboring slot on the same tab by substantially similar distances. In other embodiments, slots 1030 may be disposed at irregular intervals along a tab.

Figure 11:
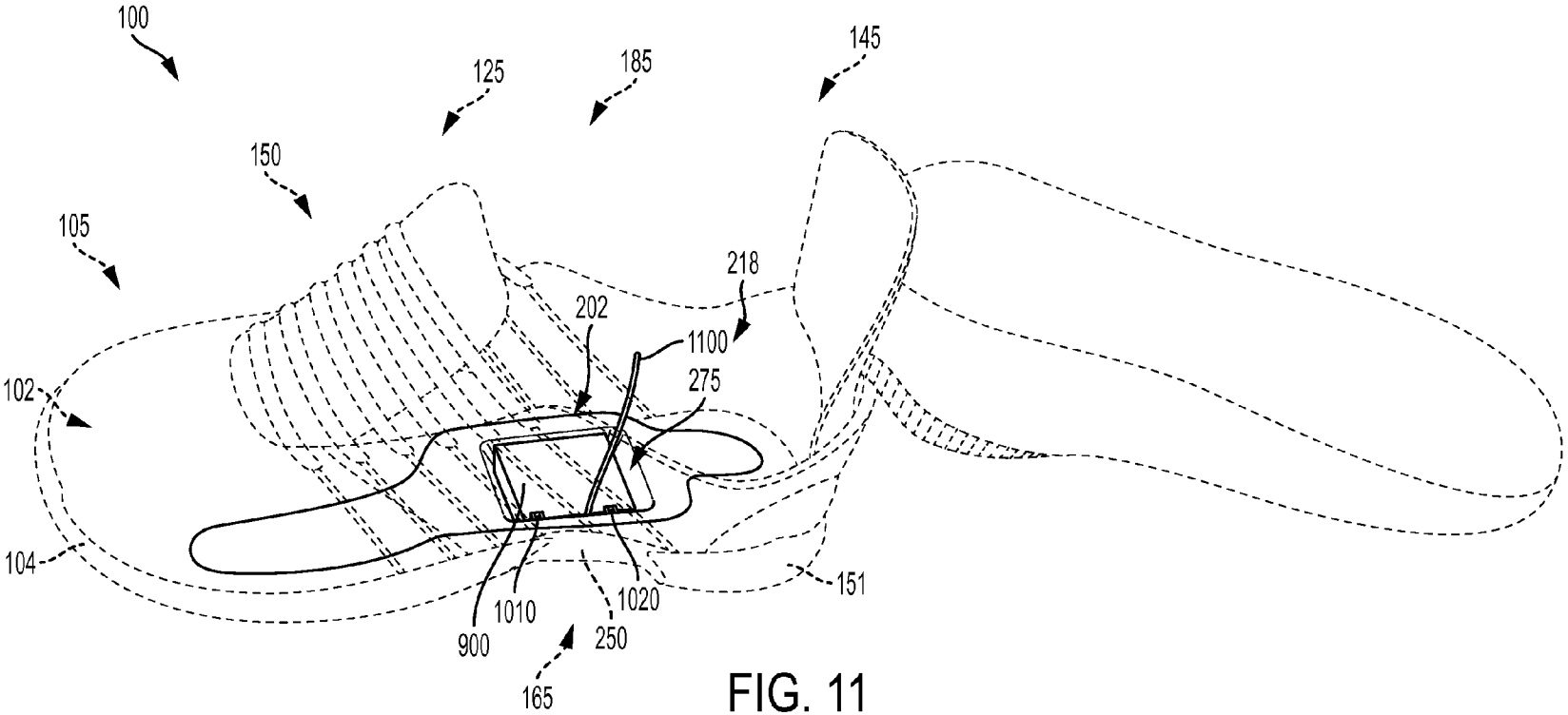
FIG. 11 is a schematic isometric view of an embodiment of a sole plate and a component.

In different embodiments, first tab 1010 and second tab 1020 may provide a mechanism for retaining a component in the interior of cavity 275. For example, referring now to FIG. 11, once component 900 is disposed within compartment 202, it may remain somewhat moveable. In some embodiments, component 900 may remain less fixedly disposed in order to facilitate a later removal of component 900 and/or reinsertion of component 900 if desired. In order to improve the securement of component 900 within cavity 275, first tab 1010 and/or second tab 1020 can be used to hold, retain, press, or otherwise steady component 900 within cavity 275 in some embodiments. Thus, in one embodiment, opening 536 remains sufficiently unobstructed for the insertion of component 900 along one side. However, once it is slid completely into cavity 275, it can remain relatively secure as a result of the inclusion of one or more tabs in some embodiments. In one embodiment, tabs can help the component resist exiting or being pushed from cavity 275.

In different embodiments, first tab 1010 and/or second tab 1020 may be associated with medial side 165 of sole plate 250, which can be advantageous in embodiments where, for example, wiring 1100 or lacing (or other elements) extending from component 900 exit from cavity 275 via medial side 165. In other embodiments, tabs may be located within sole plate 250 in a manner configured to suit the type of component and/or connection pathway of an article.

In other embodiments, it should be understood that additional materials or components may be included or inserted into sole structure 104. In one embodiment, to enhance the impact strength of sole plate 250, there may be a portion of rubber or dampening material adhered to one surface or portion of sole plate 250, for example. In other embodiments, insulating material or other filler or cushioning material may be deposited around component 900 during installation of component 900.

Figure 12:
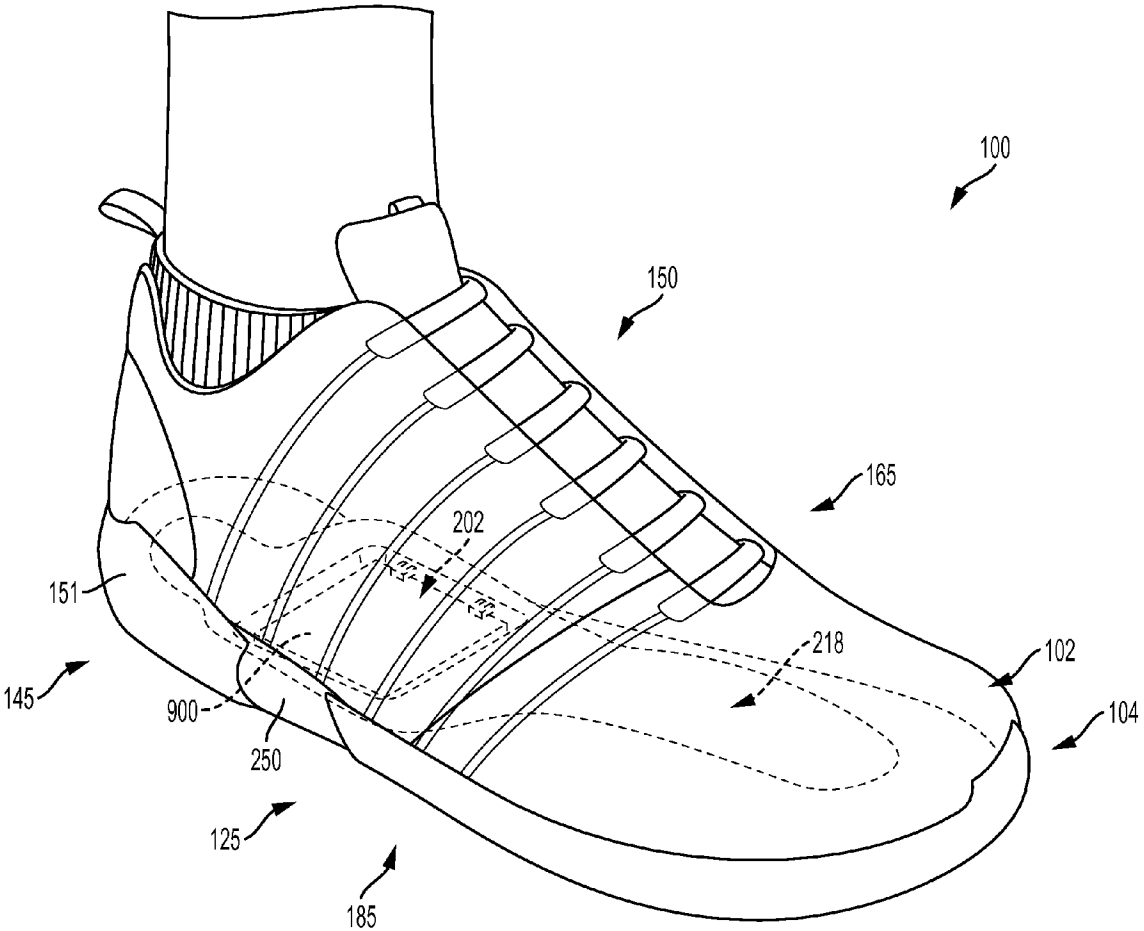
FIG. 12 is a schematic isometric view of an embodiment of an article of footwear.

Referring now to FIG. 12, article 100 is illustrated with component 900 installed. In FIG. 12, upper 102 and sole structure 104 are depicted in solid line, while component 900 and sole plate 250 are depicted in dotted lines, to provide a view of interior void 218. It can be seen that component 900 is disposed in compartment 202 within sole plate 250.

In other embodiments, any component could be disposed in any other portions of an article, including the upper and/or sole structure. In some cases, some components could be disposed in one portion of an article and other components could be disposed in another, different, portion. In another embodiment, for example, component 900 comprising the housing unit with a motorized tensioning device could be disposed near heel region 145 of sole plate 250 in article 100. The location of one or more components may be selected according to various factors including, but not limited to: size constraints, manufacturing constraints, aesthetic preferences, optimal design and functional placement, ease of removability or accessibility relative to other portions of article 100, as well as possibly other factors.

Once components have been installed in article 100, various systems may be operated or used by a wearer. For example, referring to FIG. 13, tensioning system 150 may include a housing unit and/or any of the features and components that have been described above. In one embodiment, when the system associated with article 100 is activated or utilized, a signal may be transmitted to activate an LED unit that can be disposed in the component (for example, component 900 described above with respect to FIG. 9). During use by a wearer 1350 of article 100, LED lights associated with the component can turn on and off.

In different embodiments, some regions of article 100 may be configured for providing optimal use of various components. In one example, sole plate 250—specifically the region of sole plate 250 associated with compartment 202 (particularly exposed third region 830 and/or fourth region 840 as shown in FIG. 8) may include light-diffusive, light-transmissive, translucent, and/or transparent materials. Such materials can facilitate the transmission of light from an LED (or other light source) that has been incorporated into cavity 275 or other portions of article 100 during or after manufacture of article 100.

Figure 13:
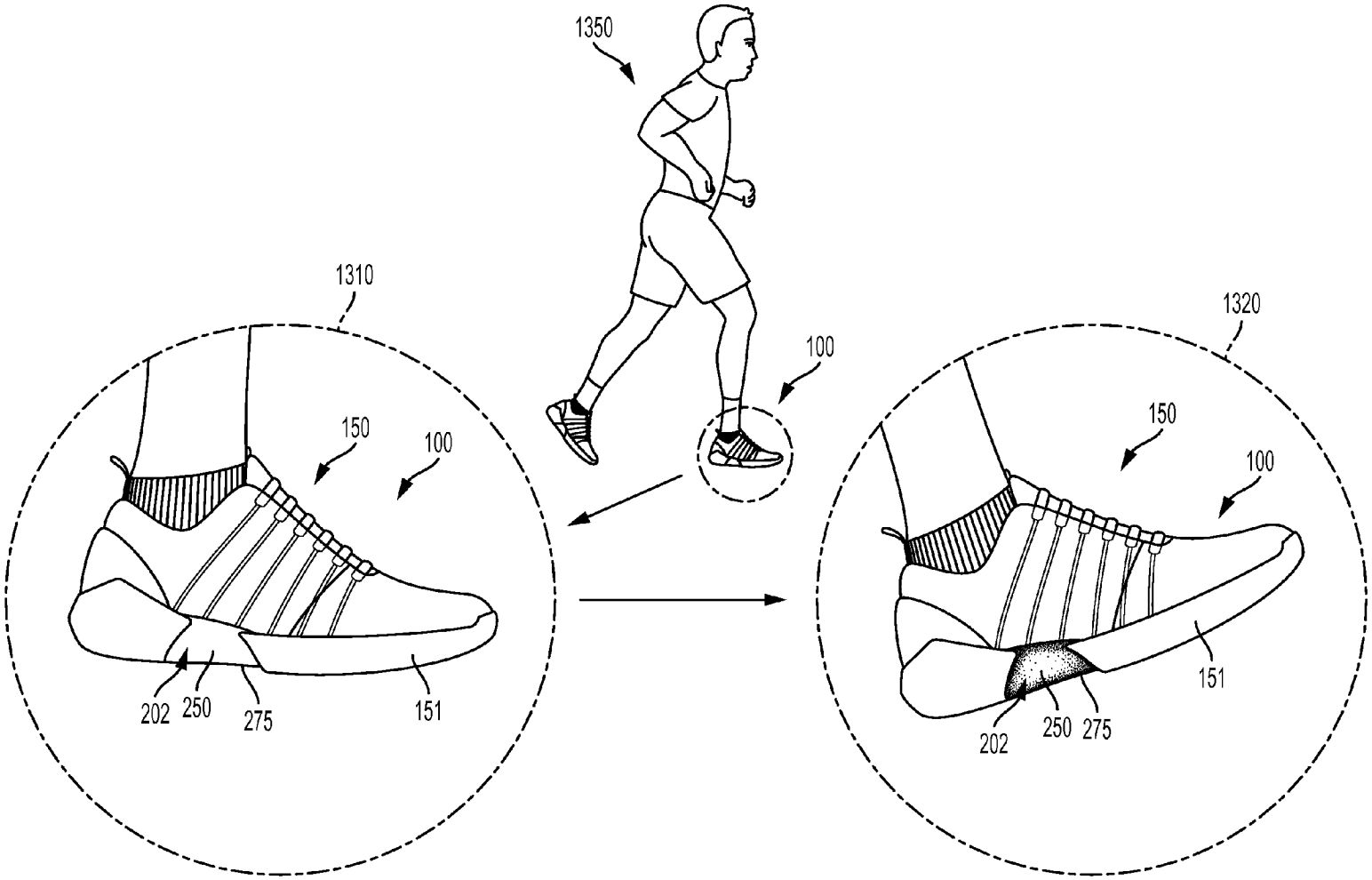
FIG. 13 is schematic isometric view of an embodiment of an article of footwear during use.

Referring to FIG. 13, the material comprising cavity 275 may be formed of a light-diffusive material, for example. Thus, component 900 comprising an LED unit may emit light that can be visible to the wearer or others via the diffuse material of sole plate 250. In some embodiments, an enhanced aesthetic design may be produced by the use of various diffusive materials with an LED unit, providing the wearer with a light diffuser effect. For example, in FIG. 13, in a first view 1310, article 100 is shown in an "LED off" state. However, as shown in a second view 1320, article 100 may transition to an "LED on" state, where one or more lights located within cavity 275 of sole plate 250 may turn on. In one embodiment, light can be emitted through the material comprising cavity 275 in the "LED on" state. This is illustrated in second view 1320 of FIG. 13, where light is being diffused through third region 830 (labeled in FIG. 8) of sole plate 250.

Furthermore, the embodiments described herein may also include or refer to techniques, concepts, features, elements, methods, and/or components from U.S. Patent Publication Number US-2016-0345679, published Dec. 1, 2016, previously U.S. patent application Ser. No. 14/723,972, filed May 28, 2015), titled "An Article of Footwear and a Method of Assembly of the Article of Footwear," ,U.S. Patent Publication Number US-2016-0345653, published Dec. 1, 2016, (previously U.S. patent application Ser. No. 14/723,832, filed May28, 2015), titled "A Lockout Feature for a Control Device," , U.S. Patent Publication Number US-2016-0345654, published Dec. 1, 2016, (previously U.S. patent application Ser. No. 14/723,880, filed May 28, 2015), titled "A Charging System for an Article of Footwear," ,and U.S. Patent Publication Number US-2016-0345655, published Dec. 1, 2016, previously U.S. patent application Ser. No. 14/724,007, filed May 28, 2015), titled "A Control Device for an Article of Footwear,",the entirety of each application being herein incorporated by reference.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A sole structure for an article of footwear, comprising:

a forefoot region, a heel region, a longitudinal axis, a lateral axis, and a midline;

a central axis extending in a direction aligned with the longitudinal axis extending from the forefoot region to the heel region, the central axis being approximately aligned with the midline of the sole structure, and the central axis dividing the sole structure into two opposing sides along the lateral axis;

the two sides of the sole structure comprising a first side and a second side;

a sole plate and a midsole, wherein the sole plate is disposed adjacent to a superior side of the midsole;

wherein the sole plate includes a forward portion, an intermediate portion, and a rearward portion, wherein a compartment is disposed along the intermediate portion, wherein the compartment comprises a cavity;

wherein the midsole includes a first portion, a bridge portion, and a second portion, wherein the bridge portion is a narrow section connecting the first portion and the second creating two opposing open regions on either side of the bridge portion, wherein the two open regions include a first open region and a second open region;

wherein the bridge portion is disposed adjacent to an inferior portion of the intermediate portion, wherein the first open region creates a first inferior exposed area of the cavity toward the first side, wherein the second open region creates a second inferior exposed area of the cavity substantially toward the second side; and wherein a size of the first exposed area is smaller than a size of the second exposed area.

2. The sole structure of claim 1, further comprising an outsole disposed adjacent to the midsole.

3. The sole structure of claim 1, wherein the midsole includes a border panel, wherein the border panel forms a recessed portion within the midsole, and wherein the recessed portion is configured to receive the sole plate.

4. The sole structure of claim 1, wherein the sole plate has a first length and a first width, wherein the midsole has a second length and a second width, wherein the first length is substantially smaller than the second length, and wherein the first width is substantially smaller than the second width.

5. The sole structure of claim 1, wherein the first portion of the midsole has a first area, wherein the forward portion of the sole plate has a second area, and wherein a size of the first area is substantially greater than a size of the second area.

6. The sole structure of claim 1, wherein the forward portion of the sole plate is associated with the first portion of the midsole and wherein the rearward portion of the sole plate is associated with the second portion of the midsole.

7. The sole structure of claim 6, wherein the forward portion is disposed substantially along the second side of the sole structure.

8. The sole structure of claim 7, wherein the rearward portion is disposed substantially along the first side of the sole structure.

9. The sole structure of claim 1, wherein the first side is associated with a medial side of the sole structure, and the second side is associated with a lateral side of the sole structure.

10. The sole structure of claim 1, wherein the first exposed area includes a first area, the second exposed area includes a second area, and wherein the first area is smaller than the second area.

11. The sole structure of claim 1, wherein the first exposed area includes a first width extending in a direction aligned with the lateral axis, the second exposed area includes a second width extending in a direction aligned with the lateral axis, and wherein the first width is smaller than the second width.

* * * * *